US005788568A

United States Patent [19]

Ito et al.

[11] Patent Number: 5,788,568

[45] Date of Patent: Aug. 4, 1998

[54] FAN

[75] Inventors: Yutaka Ito, deceased, late of Tokyo, Japan, by Masao Ito as legal representative; Yasuhiro Kato, Tokyo, Japan; Hisayuki Matsuzawa, Tokyo, Japan; Shinichiro Suzuki, Tokyo, Japan

[73] Assignee: Mitsubishi Denki Kabushiki Kaisha, Tokyo, Japan

[21] Appl. No.: 699,864

[22] Filed: Aug. 20, 1996

[30] Foreign Application Priority Data

Aug. 25, 1995 [JP] Japan ..... 7-217195

[51] Int. Cl.[6] ..... F24F 9/00

[52] U.S. Cl. ..... 454/188; 415/119; 454/333; 454/192

[58] Field of Search ..... 454/188, 338, 454/906, 192; 415/119

[56] References Cited

U.S. PATENT DOCUMENTS

| | | | |
|---|---|---|---|
| 4,185,688 | 1/1980 | Wiater et al. | 165/122 |
| 4,523,630 | 6/1985 | Wiklund | 165/18 |
| 5,297,990 | 3/1994 | Renz et al. | 454/187 |
| 5,370,576 | 12/1994 | Krofchalk | 454/143 |

FOREIGN PATENT DOCUMENTS

| | | | |
|---|---|---|---|
| 000155924 | 9/1985 | European Pat. Off. | 454/188 |
| 2701845 | 8/1977 | Germany | 454/188 |
| 828926 | 2/1996 | Japan . | |

*Primary Examiner*—Harold Joyce
*Assistant Examiner*—Derek S. Boles

[57] ABSTRACT

A fan comprising: blowing units, each including a squarely hollow casing, an electric motor incorporated into the casing and an axial impeller coupled to the motor for generating an air flow from an inlet toward nozzles; the casing having one end opened to form the inlet and the opposite end opened to form the nozzles; and a guide which projects into the casing to arrange the nozzles in a parallel pattern, in a slit shape and in rows; wherein the blowing units are coupled together at adjacent sides thereof to be arranged in a row, each unit has the inlet provided with a bellmouth which surrounds impeller, and a space between each bellmouth and each casing is separated from an air flow path with the air flow generated by the impeller passing therethrough.

8 Claims, 8 Drawing Sheets

FAN

BACKGROUND OF THE INVENTION

1. Field of the Invention

The present invention pertains to the technical field of a fan for forming an air curtain at an opening of a building.

2. Discussion of Background

Such an air curtain is formed by cross flow fans with air flowing across impellers or axial fans. In case of using the axial fans, axial fan units 101 each which are respectively constructed to work as an independent fan are arranged in a row to provide a collective fan as a whole as shown in FIG. 9. Although it is difficult to modify the entire length of a collective fan in case of using the cross flow fans, the arrangement of the units 101 as just above mentioned allows the entire length to be easily modified by increasing or decreasing the number of the units 101 or adjusting spacing between the units 101.

The air curtain is discharged directly downward or downward at an angle with respect to the vertical direction as needed. The discharging direction of the air curtain is changed by adjusting the direction of outlets of the collective fan. In practice, the entire collective fan is usually mounted to metal fittings fixed on a wall structure at an upper portion in an opening of a building so that the entire collective fan can be rotated within a predetermined range. For example, in the collective fan shown in FIG. 9, each metal fitting 103 for mounting the fan to the wall structure has a downward recess 104 formed therein, and each latch 105 is provided on a rear side of the fan to project therefrom as shown in FIG. 10. Each metal fitting 103 has a lower end formed with a curved receiving member 106 projecting forwardly, and each latch 105 has a lower end formed with a curved adjusting member 107 to be held by the receiving member. Each receiving member 106 has an elongated hole formed therein in the curved direction thereof, and an adjusting bolt 108 is fastened to the adjusting member 107 through the elongated hole. When the adjusting bolts 108 are loosened with the latches 105 engaged in the recesses 104 of the metal fittings 103, the entire fan can be moved around the shafts of the latches 105 within a range defined by the elongated holes of the receiving members 106. When the adjusting bolts 108 are fastened having a suitable inclination, the fan can be fixed at that position.

The collective fan with axial fans in a row as stated earlier creates some problems. One of them is that discharged air volume lowers due to turbulence air in each unit 101. In detail, the inlet of each unit 101 is formed in a circular shape as the opening of a bellmouth to improve suction performance. Although the bellmouth has an outlet side opened in a circular shape inevitably, a portion of a casing forming each unit which faces the outlet side of the bellmouth is formed in a square shape to provide slit-shaped outlets, forming an air curtain. As a result, there is provided a space between the outer circumference of each bellmouth and the casing, which communicates with an air flow path at the outlet side. A portion of an air flow which has gotten out of each bellmouth is drawn into the space, causing the air flow to be disturbed, and air volume, consequently a discharged air speed to be lowered.

Another problem is that when the collective fan is inclined in a direction for getting the outlets away from the wall at a large angle, the collective fan has an upper edge positioned near to the ceiling or the eaves of an installing location, and a suction space is provided in an insufficient manner to lower suction air volume because the collective fan has a structure wherein a mounting angel is adjusted by rotating the fan around the shafts at a position apart from the rear side of the fan. The adjusting bolts 108 which are used for fixing the fan at a predetermined angle are constantly loaded due to a moment of the fan, creating problems in that an adjusting operation can not be carried out without supporting the fan by hands and also that the adjusting bolts 108 themselves fail to function properly in a relatively short period of time.

Another is that curtain flows at both outermost ends of the fan in the longitudinal direction have a lower discharged air speed than those at the intermediate portion of the fan to have short reach so as to unequalize the curtain flows as a whole because the curtain flows at both outermost ends involve surrounding air and are subjected to resistance.

SUMMARY OF THE INVENTION

It is an object of the present invention to eliminate the disadvantage of the conventional collective fan and to provide a new and improved fan capable of having a new arrangement of axial fans to improve air flow performance.

It is another object of the present invention to provide a new and improved fan capable of facilitating a mounting operation.

It is a further object of the invention to provide a new and improved fan capable of preventing functioning parts from failing to function properly.

It is a still further object of the invention provide a new and improved fan capable of equalizing curtain flows.

The foregoing and other objects of the present invention have been attained by providing a fan comprising blowing units, each including a squarely hollow casing, an electric motor incorporated into the casing and an axial impeller coupled to the motor for generating an air flow from an inlet toward nozzles; the casing having one end opened to form the inlets and the opposite end opened to form the nozzles; and a guide which projects into the casing to arrange the nozzles in a parallel pattern, in a slit shape and in rows; wherein the blowing units are coupled together at adjacent sides thereof to be arranged in a row, each unit has the inlet provided with a bellmouth which surrounds the impeller, and a space between each bellmouth and each casing is separated from an air flow path with the air flow generated by the impeller passing therethrough.

It is preferable that each bellmouth has an inlet end closed by a flange formed therewith in a one-piece construction, and each bellmouth has an outlet end closed by a closure plate, whereby the space between each bellmouth and each casing is separated from the air flow path with the air flow generated by the impeller passing therethrough.

It is preferable that each bellmouth has an inlet end closed by a flange formed therewith in a one-piece construction, and the space between each bellmouth and each casing is filled with a lightweight filling material, whereby the space between the bellmouth and the casing is separated from the air flow path with the air flow generated by the impeller passing therethrough.

It is preferable that each bellmouth has an inlet end and an outlet end provided with flanges projecting in a radial direction, whereby the flanges separate the space between each bellmouth and each casing from the air flow path with the air flow generated by the impeller passing therethrough.

It is preferable that the coupled blowing units are housed in a housing, and blowing units which are located at both outermost ends of the coupled blowing units have respectively a supporting arm provided thereon, the supporting arm including rotational adjusting means coupled at a central portion on an outermost surface of the blowing unit, whereby the coupled blowing units can be selectively rotated around the rotational adjusting means as a whole.

It is preferable that the supporting arm has a position setting arm formed therewith in a one-piece construction to extend downward therefrom, and the position setting arm has a lower end selectively bolted onto the housing to fix the coupled blowing units in a desired angular position.

It is preferable that blowing units which are located at both outermost ends of the coupled blowing units have a discharged air speed which is higher than that of the remaining blowing units.

It is preferable that blowing units which are located at both outermost ends of the coupled blowing units are located at a lower position than the remaining blowing units in a discharging direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Now, the present invention will be described in detail in reference to embodiments shown in the accompanying drawings.

EMBODIMENT 1

Figure 1:
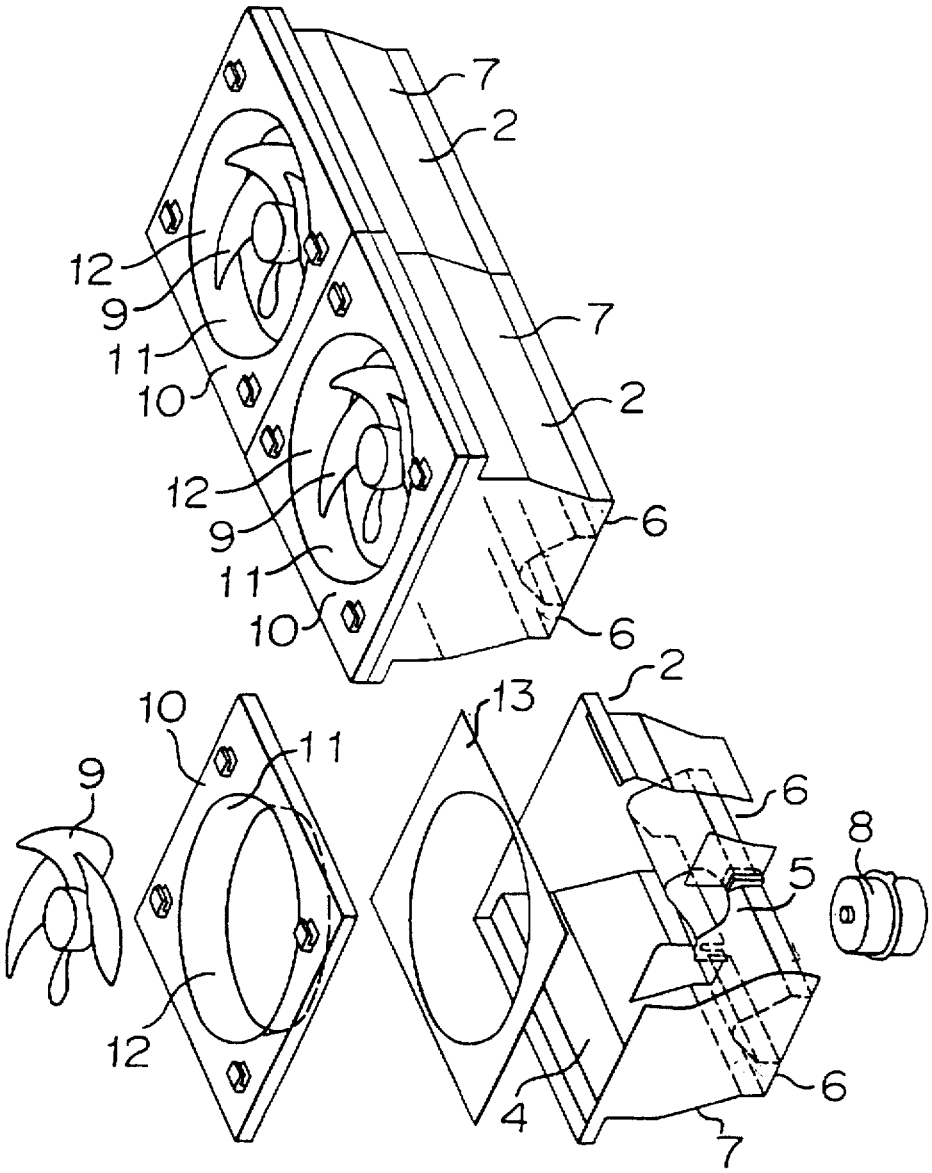
FIG. 1 is an exploded perspective view of the fan according to a first embodiment of the present invention, portions of the fan being omitted.
Figure 2:
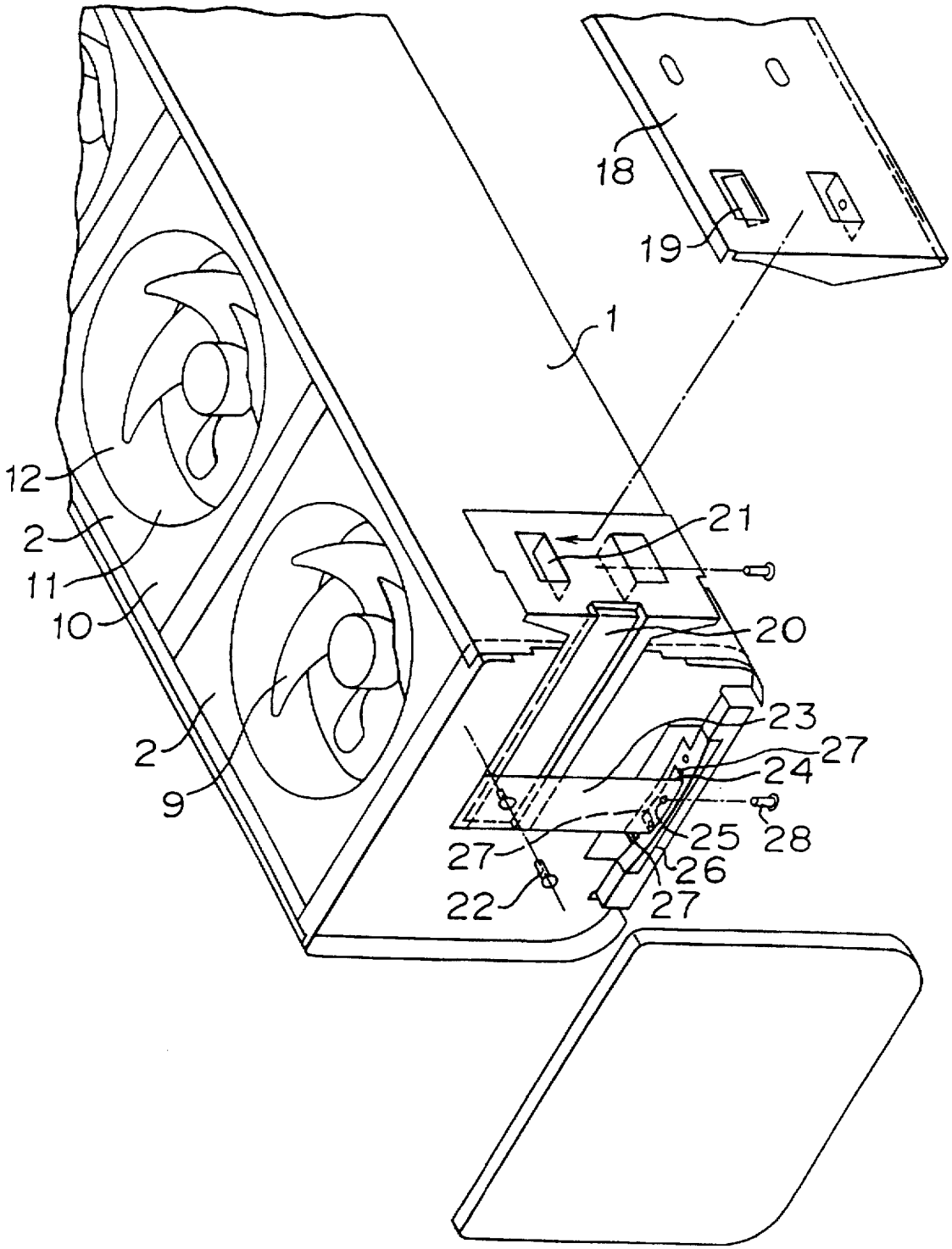
FIG. 2 is an exploded perspective view of the structure of the main portion of the fan according to the first embodiment.
Figure 3:
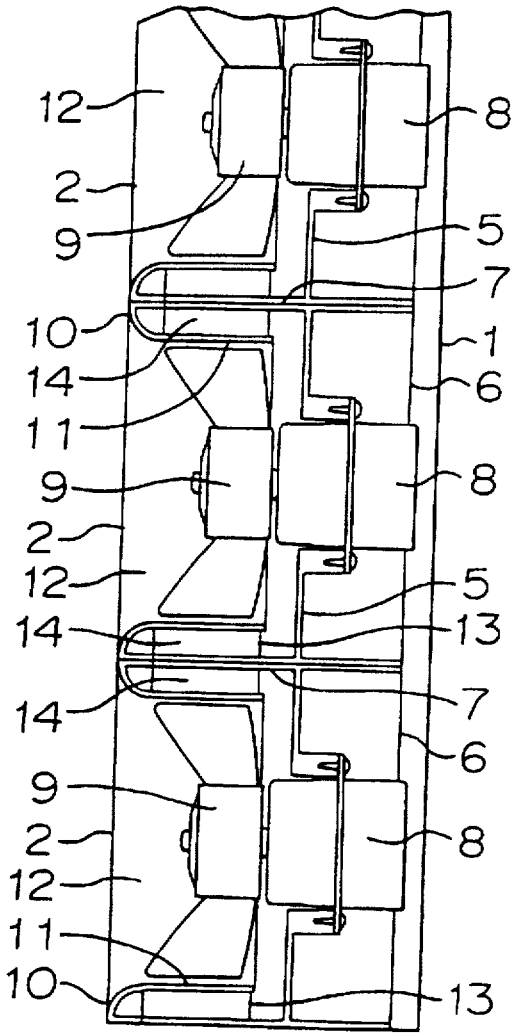
FIG. 3 is an enlarged sectional view of a portion of the fan according to the first embodiment as viewed in the longitudinal direction.
Figure 4:
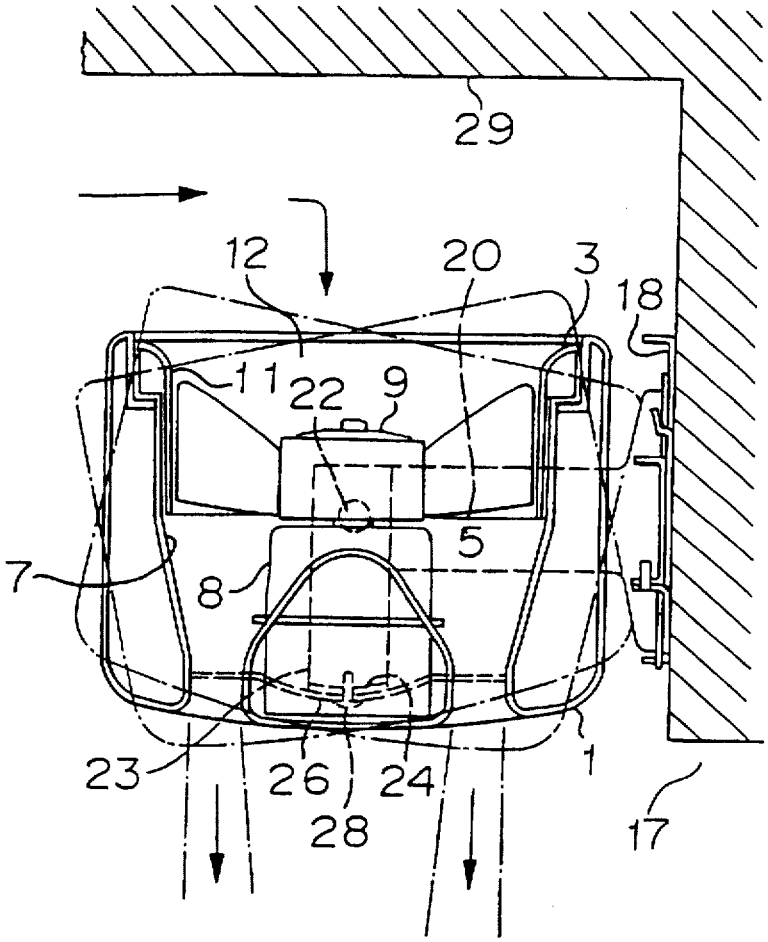
FIG. 4 is an enlarged sectional view of the fan according to the first embodiment as viewed in the width direction.

In FIG. 1, there is shown an exploded perspective view of the fan according to a first embodiment of the present invention, portions of the fan being omitted. In FIG. 2, there is shown an exploded perspective view of the main portion of the fan. In FIG. 3, there is shown an enlarged sectional view of a portion of the fan in the longitudinal direction. In FIG. 4, there is shown an enlarged sectional view of the fan in the width direction. The fan is constituted by having a plurality of blowing units laterally displaced in a row in a housing 1 which is formed in an elongated frame body with upper and lower ends opened. The housing 1 is made of sheet metal. The housing has stepped receivers 3 provided therein at a forward end and a rear end of the upper opened portion, and the lower opened portion is formed by inwardly bent portions at the front and rear ends to be narrower than the upper opened portion as shown in FIG. 4. Free ends of the inwardly bent portions at the front and rear ends project into the housing upward. The housing 1 may have a dividable structure wherein a combination of an elongated hole and a bolt (not shown) which are provided in overlapping portions can adjust the entire length of the fan within a range defined by the length of the elongated hole.

The respective blowing units 2 are all formed in the same shape and the same size. Specifically, each blowing unit 2 has such a structure that an electric motor 8 and an axial impeller 9 are incorporated into a square-shaped hollow casing 7 which has an upper end opened as an inlet 4 and a lower end opened downward as slit-shaped parallel nozzles 6, the nozzles being formed in rows at the front and rear sides on the lower end by providing an angled guide 5 projecting into the casing, as shown in FIGS. 1 and 2. The casing 7 has stepped portions formed at upper front and upper rear positions therein to be received and supported by the stepped receivers 3 of the housing 1, and has engaged portions (not shown) formed at a lower portion therein to be engaged with free ends of the bent portions at the front and rear sides of the housing 1. The guide 5 in each casing 7 continuously extends at the lower portion of the casing 7 in the horizontal direction, and the guide 5 works to branch an air flow path in the casing 7 such that the air flow is directed into the parallel nozzles 6 by means of slanted surfaces of the guide.

To the inlet 4 of each casing 7 is mounted a plastic inlet part as a lid by fitting, which includes an upper square and flat flange 10 with a bellmouth 11 integrally formed at a central portion thereof. The bellmouth 11 of the inlet part forms a substantially circular inlet 12 and the upper flange 10 has an upper surface integrally formed at suitable positions with projections for mounting a guard in a detachable manner. The bellmouth 11 itself extends in a cylindrical shape to project into the casing 7 so as to surround an outer periphery of the axial impeller 9. To an outer periphery of the outlet side of the bellmouth 11 is fitted a thin, square and flat plastic closure plate 13 which is slightly smaller than the upper flange 10. The closure plate 13 has outer end surfaces that are in close contact with an inner surface of the casing 7 by mounting the inlet part to the casing 7, and a space 14 which is formed between the outer periphery of the bellmouth 11 and the inner surfaces of the casing 7 is closed by the closure plate 13 and the upper flange 10 in each casing as shown in FIG. 3. In other words, the space 14 which is formed between the outer periphery of the bellmouth 11 and the inner surface of the casing 7 in each casing is isolated with respect to the air flow path where an air flow generated by the axial impeller 9 passes.

Figure 5:
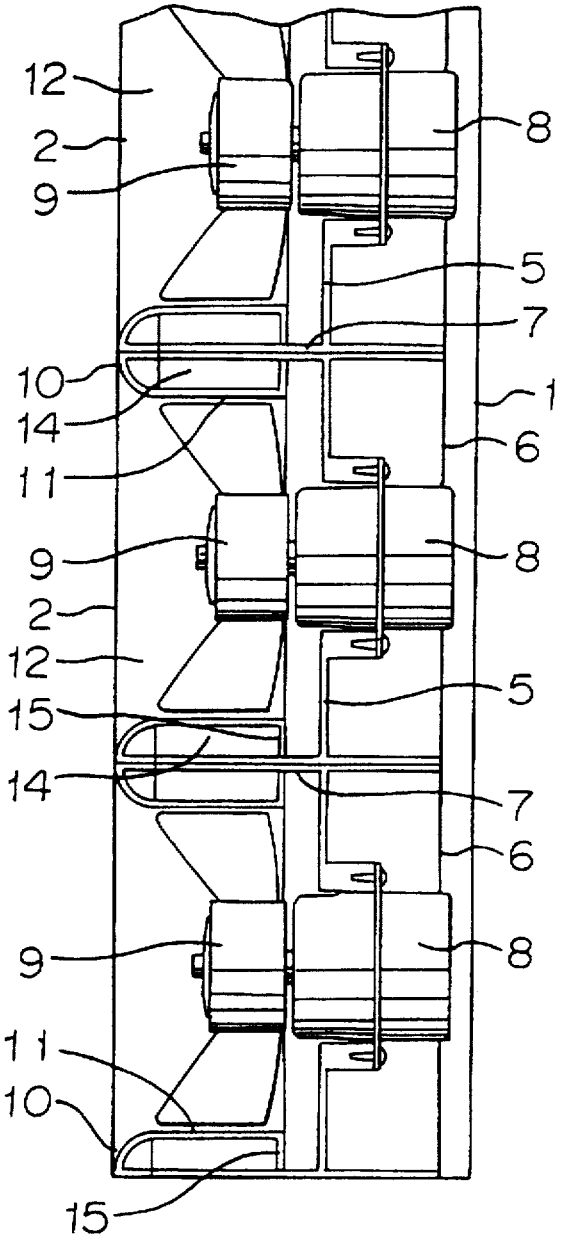
FIG. 5 is an enlarged sectional view of a portion of the fan in a modified form according to the first embodiment.
Figure 6:
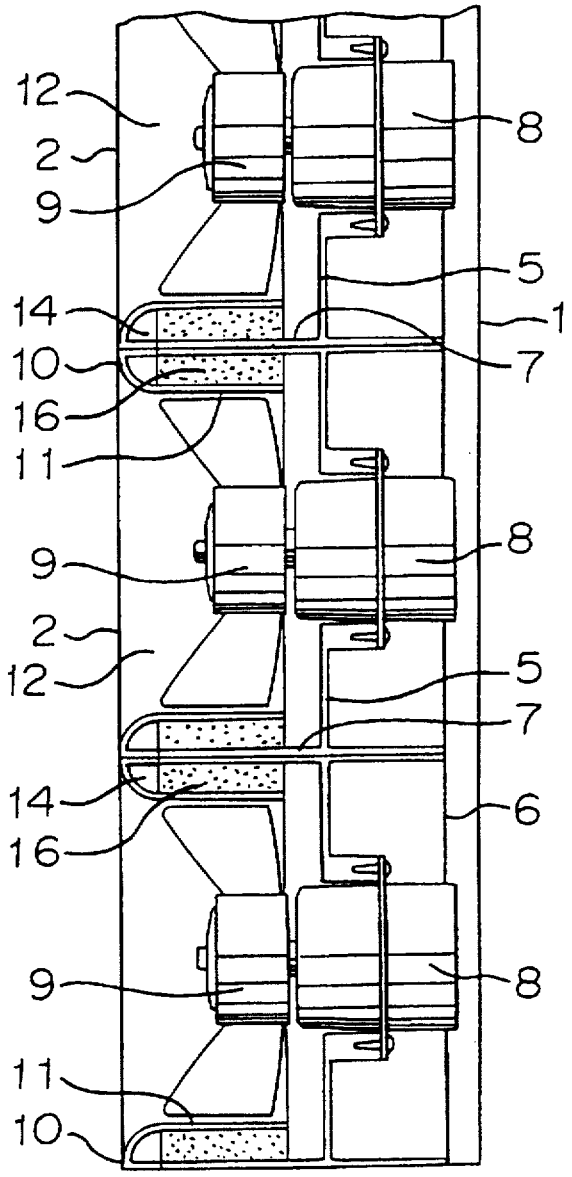
FIG. 6 is an enlarged sectional view of a portion of the fan in another modified form according to the first embodiment.

Each closure plate 13 closes the space 14 around the outer periphery of the bellmouth 11 at the outlet side of the bellmouth 11, and may be integrally formed with the inlet part to provide a lower flange 15 extending horizontally from a lower end of the bellmouth 11 as shown in FIG. 5. As shown in FIG. 6, each space 14 which is formed between the outer periphery of the bellmouth 11 and the inner surface of the casing 7 may be filled with a lightweight filling material 16 to separate the air flow path from the space 14 without using the closure plate 13 or the lower flange 15. As the filling material 16, a foamed material such as polyurethane foam, or a spongy material can be used, and if the filling material 11 has sound absorbing performance, sound absorbing performance as well as shielding performance can be obtained.

The guide 5 in each casing 7 has an intermediate portion formed with an electric motor mounting structure. The electric motor mounting structure is constituted by an electric motor mounting hole formed in the guide 5, an edge of the hole and ribs extended between the guide and the respective front and rear walls. The ribs have basic positions at the motor mounting hole side formed with mounting portions for bolting the motor 8 thereto. The motor 8 is fitted into the motor mounting hole from downward, and the motor has its mounting flange bolted to the mounting portion for fixture. Almost half of the motor 8 is stored in the guide 5. The motor 8 has a rotary shaft projecting into the casing 7, and the rotary shaft has the axial impeller 9 carried thereon to rotate in the bellmouth 11 to form an air flow in the air flow path from the inlet 12 to the respective parallel nozzles 6. The guide 5 has electrical equipment such as a capacitor and a terminal board, and wiring collectively arranged therein in addition to the motor 8.

The fan according to the present invention is constituted by housing and arranging a plurality of the blowing units 2 in a row in the housing 1, and the entire length of the fan can be adjusted by an easy operation such as adjustment of spacing between adjoining blowing units 2. Mounting the fan can be carried out by mounting metal fittings 18 to two positions of an upper portion of an opening 17 of a building, hooking engagement portions of supporting arms 20 over engagement pieces 19 provided on the metal fittings 18 and bolting the engagement portions and the engagement pieces together as shown in FIGS. 2 and 4. The supporting arms 20 respectively project from both ends of the housing 1 backwardly.

Each supporting arm 20 is mounted to a central portion on an outer end surface of each outermost blowing units 2 by tightening a rotary adjusting bolt 22 from outward in each outermost side plate of the housing 1. The supporting arm can be rotated about the rotary adjusting bolt 22 in a vertical plane with a predetermined range with respect to the blowing unit 2. Each supporting arm 20 has a portion with the rotary adjusting bolt 22 bolted therein formed integrally with a position setting arm 23 to downward extend therefrom. Each position setting arm 23 has a free end formed with an arced fixing piece 24 formed so as to extend toward the outermost side of the blowing unit 2. Each fixing piece 24 has a central portion formed with a threaded hole 25. The fixing piece 24 has a lower arced surface slidably contacted with a position setting member 26 which is formed at a lower portion of each outermost end of the housing 1. Each position setting member 26 has a plurality of through holes 27 formed therein at predetermined intervals to be selectively conformable with the threaded hole 25 in the fixing piece 24. An adjusting bolt 28 is bolted into the threaded hole in the fixing piece 24 from a lower side of the position setting member 26 through one of the through holes 27.

In the fan according to the present invention, two air flows can be discharged by the respective blowing units 2 to form air curtains. In each blowing unit 2, the space 14 which is formed between the outer periphery of the bellmouth 11 and the casing 7 is isolated from the air flow path to prevent a portion of the air flow from being withdrawn into the space 14 after having gotten out of the bellmouth 11. As a result, almost no air is disturbed by the axial impeller 9, preventing discharged air volume, consequently discharged air speed from lowering, and improving air flow performance.

When the space 14 is isolated by fitting the closure plate 13 into each casing, the closure plate 13 can have a simple structure wherein a thin plate has a central portion formed with a round hole, and the closure plate can support the free end of the bellmouth 11 with respect to the inner surface of the casing 7 to prevent the bellmouth 11 from vibrating, offering a stable structure.

When the space 14 is isolated by the upper flange 10 and the lower flange 15 integrally formed with the bellmouth 11 in each casing, the bellmouth 11 has both ends reinforced and supported without increasing the number of required parts. As a result, the wall thickness of the bellmouth 11 itself can be made thinner than a conventional one.

When the space 14 is isolated by filling the filling material 16 in each casing, the filling material 16 which is existing can be used, allowing the structure to be simplified and a sound absorbing effect to be expected by using a sound absorbing material.

The fan according to the present invention can easily adjust the discharging direction of curtain flows in a mounting position. Specifically, the fan which has both ends supported by the metal fittings 18 through the supporting arms 20 at both ends can be easily rotated about a substantially center line thereof in the longitudinal direction as a rotary axis by removing the adjusting bolts 28 and loosening the rotary adjusting bolts 22. Since the rotary adjusting bolts 22 are located substantially at the center of the outer side of each outermost blowing unit 2, the rotary adjusting bolts can be easily loosened even if the fan is firmly supported by hands. When the fan is mounted downwardly in the vertical direction, the rotary adjusting bolts can be loosened without any specific handling because almost no moment is caused even if the fan is not supported by hands.

The discharging angle can be adjusted by changing the conforming relationship between a through hole 27 in the position setting member 26 and the threaded hole 25 in the fixing piece 24, tightening the adjusting bolt 28 into the fixing piece from the lower side of the position setting member 26 and tightening the rotary adjusting bolt 22 into the supporting arm at each outermost blowing unit. Since the adjusting bolt 28 is screwed into a lower end of the position setting arm 23 downward projecting from the supporting arm 20 at each outermost casing, the adjusting bolt is subjected to almost no load by the fan even if the fan is mounted in a inclined position. As a result, a thread on the adjusting bolt can be prevented from being crushed, maintaining a screwing function for a long period of time.

In most cases, a ceiling 29 or eaves is located near to an upper portion of the fan at an upper portion of an installing location as shown in FIG. 4. Since the rotational center in the angular adjustment lies on the substantially center line of the fan in the longitudinal direction, a required distance between an upper edge of the fan and the ceiling 29 or the eaves above the fan can be ensured even if the fan is inclined at the maximum angle as shown by broken line in FIG. 4. As a result, a decrease in suction air volume can be minimized to prevent air flow performance from lowering.

EMBODIMENT 2

Figure 7:
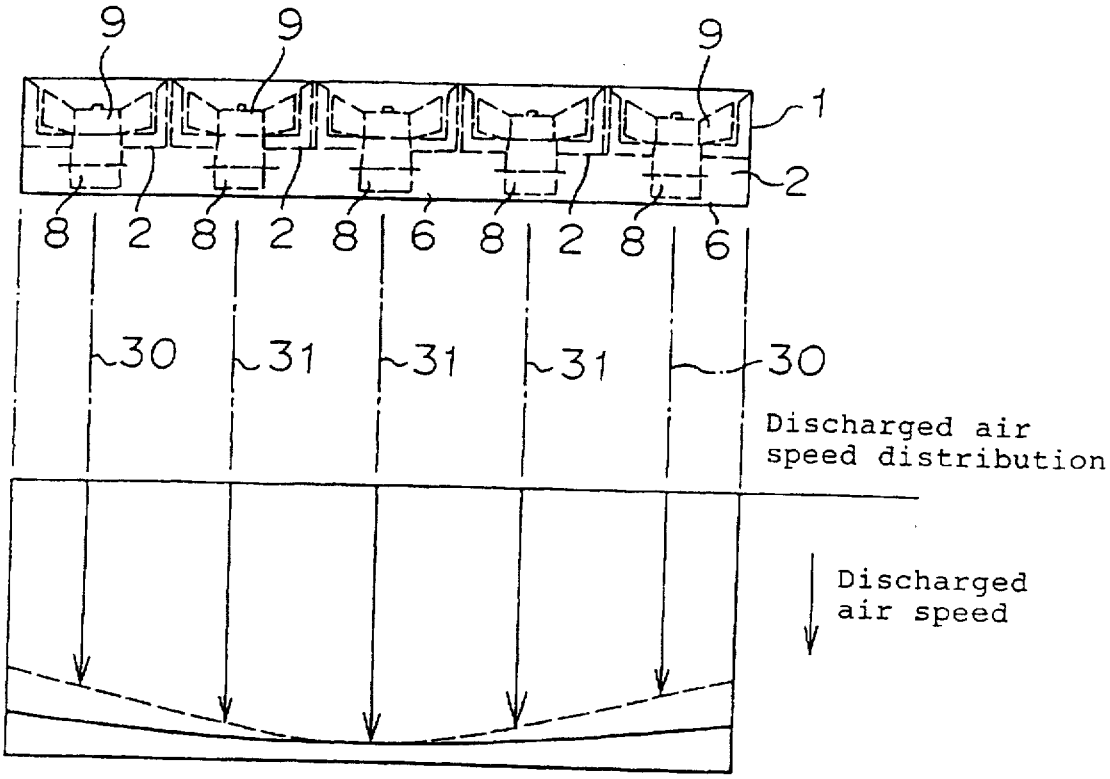
FIG. 7 is a schematic view showing the relationship the fan and the air curtain according to the second embodiment of the invention.

In FIG. 7, there is shown a schematic view of a second embodiment according to the present invention. Since the fan itself according to the second embodiment has the same basic structure as the fan according to the first embodiment, identical or similar parts are indicated by the same reference numerals as the first embodiment, and explanation about those parts is omitted for simplicity.

In the air curtain formed by the fan according to the first embodiment, curtain flows 30 at both ends of the fan in the longitudinal direction have a slower discharged air speed and shorter reach than curtain flows 31 in the intermediate portion of the fan as shown in FIG. 7 because the curtain flows 30 at both ends involve surrounding air and are subjected to resistance by the surrounding air. The curtain flows 30 have weak power portions formed therein at portions near to a floor surface below both ends of the fan, and dirt and dust can enter through the weak power portions. The second embodiment can solve unevenness given by such curtain flows 30.

In order to equalize the curtain flows 30 and 31 as a whole, there are several solutions. One of the solutions is that the output of the electric motors 8 which are at the outermost blowing units 2 is set to larger than that of the electric motors 8 which are at the other blowing unit 2. In practice, it is the easiest and effective to adopt this solution. Specifically, the output of the electric motor 8 which are at the outermost blowing units 2 is set about 1.2 to 1.5 times that of the electric motors 8 which are at the other blowing units 2. The electric motors 8 which are at the intermediate blowing units 2 have the same output. The fan which have the outputs thus set exhibits discharged air speed distribution as shown by a solid line in FIG. 7, unifying the curtain flows 30 and 31 in comparison with a conventional fan with equal outputs as shown by a dotted line in FIG. 7.

Another solution is that the output of the electric motors 8 which are at the intermediate blowing units 2 is set to be smaller than that of the outermost blowing units 2 in contrast with the solution stated just above. Specifically, the output of the electric motors 8 which are at the intermediate blowing units 2 is set to be about 1/1.2 to 1/1.5 times that of the electric motors 8 which are at the outermost blowing units 2. The respective electric motors 8 which are at the outermost blowing fans are set to have the same output. The fan which have the outputs thus set exhibits an upward reversed one of the discharged air speed distribution shown by the solid line in FIG. 7, unifying the curtain flows 30 and 31 in comparison with the conventional fan with equal outputs shown by the dotted line.

Figure 8:
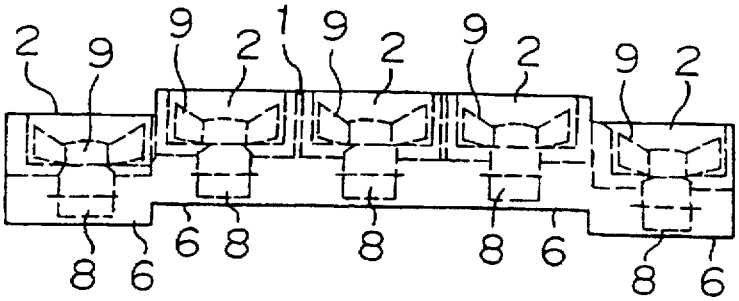
FIG. 8 is a front view of the fan in a modified form according to the second embodiment.
Figure 9:
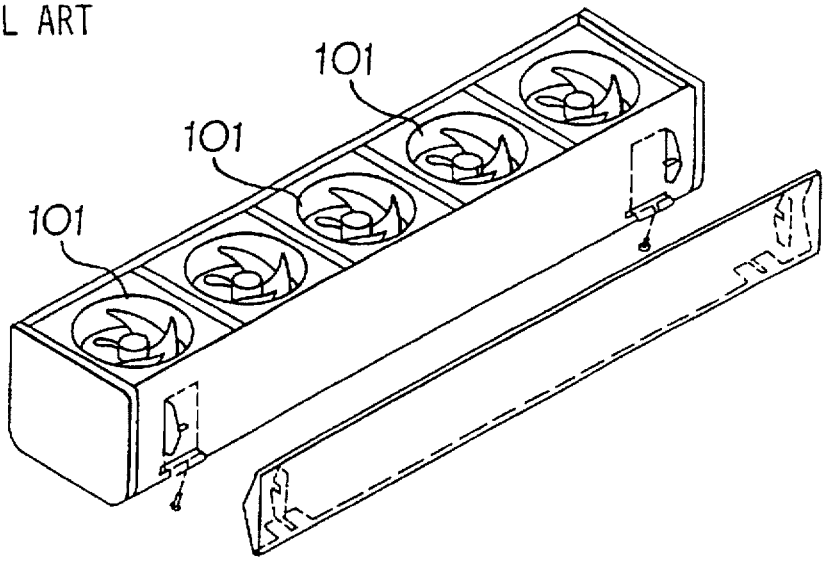
FIGURE 9 CONVENTIONAL ART
FIG. 9 is a perspective view of a conventional fan.
Figure 10:
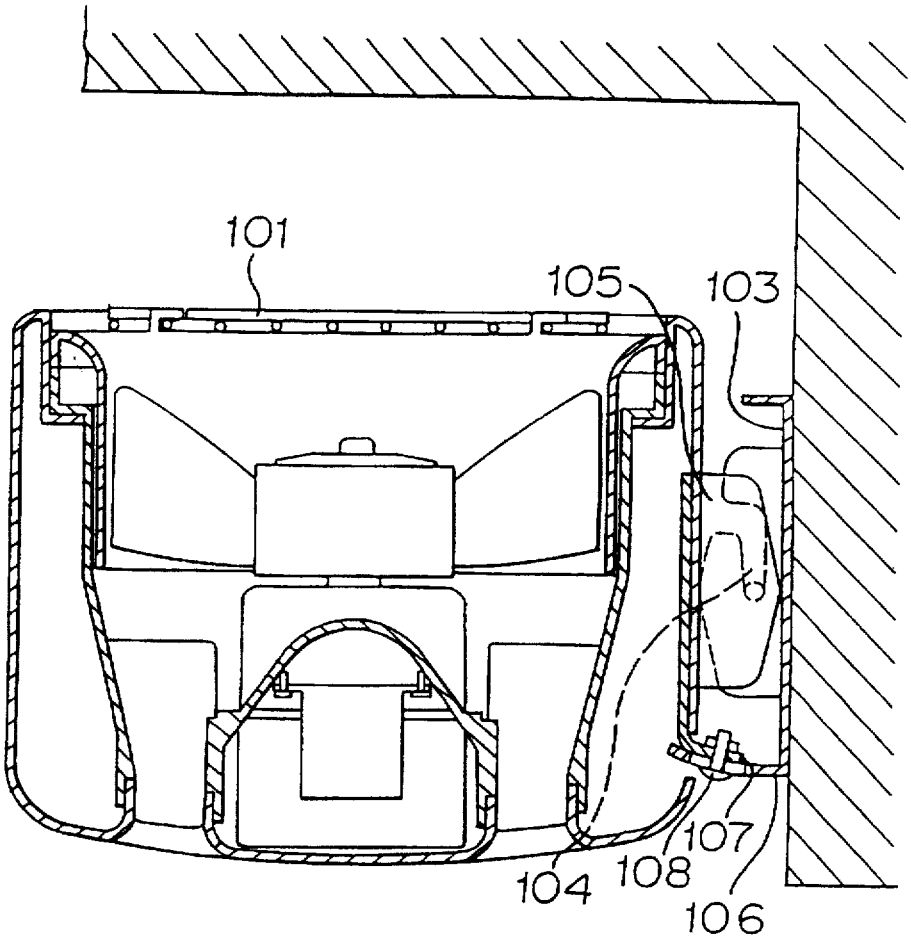
FIGURE 10 CONVENTIONAL ART
FIG. 10 is an enlarged sectional view of the conventional fan.

Still another solution is that the electric motors 8 all have the same output, and that the outermost blowing unit 2 are located at a lower position than the intermediate blowing units 2 as shown in FIG. 8. In detail, the outlets of the parallel nozzles 6 in the outermost blowing units 2 are nearer to the floor than those in the intermediate blowing units to be balanced with the intermediate blowing units in terms of an attenuation in discharged air speed. The curtain flows 30 from the outermost blowing units attenuate later than the curtain flows from the intermediate blowing units, and consequently the curtain flows 30 and 31 can be unified in the entire air curtains.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fan, comprising:

blowing units, each of said blowing units including a square-shaped hollow casing, an electric motor incorporated into the casing and an axial impeller coupled to the motor for generating an air flow from an inlet of said casing toward an outlet of said casing;

said casing having a first open end forming the inlet and a second open end opposite to the first open end wherein the second open end is provided with nozzles; and a guide which projects into the casing to arrange the nozzles in a parallel pattern, in a slit shape and in rows;

said blowing units coupled together at adjacent sides thereof to form a row of blowing units;

wherein each of said blowing units has the inlet provided with a bellmouth which surrounds the axial impeller; and means for blocking a space between each bellmouth and each casing to thereby block an air flow path through the space and separate the space from the air flow generated by the axial impeller.

2. The fan according to claim 1, wherein each bellmouth has an inlet end a periphery of which is closed by a flange formed therewith in a one-piece construction, and said means for blocking including a closure plate closing an outer peripheral portion of the bellmouth, whereby the space between each bellmouth and each casing is separated from the air flow generated by the axial impeller.

3. The fan according to claim 1, wherein each bellmouth has an inlet end a periphery of which is closed by a flange formed therewith in a one-piece construction, and said means for blocking including a lightweight filling material for filling the space between each bellmouth and each casing, whereby the space between the bellmouth and the casing is separated from the air flow generated by the axial impeller.

4. The fan according to claim 1, said means for blocking including flanges provided at an inlet end and an outlet end of each bellmouth, the flanges projecting in a radial direction, whereby the flanges separate the space between each bellmouth and each casing from the air flow generated by the axial impeller.

5. The fan according to claim 1, wherein said coupled blowing units are housed in a housing, and wherein blowing units which are located at both outermost ends of the coupled blowing units each have a supporting arm provided thereon, the supporting arm including rotational adjusting means coupled at a central portion thereof on an outermost surface of said blowing unit, whereby the coupled blowing units can be selectively rotated around the rotational adjusting means as a whole.

6. The fan according to claim 5, wherein the supporting arm has a position setting arm formed therewith in a one-piece construction to extend downward therefrom, and the position setting arm has a lower end selectively bolted onto the housing to fix the coupled blowing units in a desired angular position.

7. The fan according to claim 1, wherein blowing units which are located at both outermost ends of said coupled blowing units have a relative discharge air speed which is higher than that of the remaining blowing units.

8. The fan according to claim 1, wherein blowing units which are located at both outermost ends of said coupled blowing units are located at a lower position in a discharging direction than the remaining blowing units.

* * * * *